US011431089B2

(12) United States Patent
Su et al.

(10) Patent No.: US 11,431,089 B2
(45) Date of Patent: Aug. 30, 2022

(54) ANTENNA HOUSING

(71) Applicant: CommScope Technologies LLC, Hickory, NC (US)

(72) Inventors: Ruixin Su, Suzhou (CN); Puliang Tang, Suzhou (CN); Meihua Yin, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 281 days.

(21) Appl. No.: 16/459,827

(22) Filed: Jul. 2, 2019

(65) Prior Publication Data

US 2020/0036092 A1 Jan. 30, 2020

(30) Foreign Application Priority Data

Jul. 24, 2018 (CN) ..... 201810814952.5

(51) Int. Cl.
*H01Q 1/42* (2006.01)
*H01Q 1/02* (2006.01)

(52) U.S. Cl.
CPC ..... *H01Q 1/42* (2013.01); *H01Q 1/02* (2013.01)

(58) Field of Classification Search
CPC ..... H01Q 1/42
See application file for complete search history.

(56) References Cited

U.S. PATENT DOCUMENTS 5,844,529 A * 12/1998 Bell ..... H01Q 1/246 343/872
7,414,588 B2 * 8/2008 Tateno ..... H01Q 1/1214 343/713
2007/0046551 A1 * 3/2007 Tateno ..... H01Q 1/3275 343/713

(Continued)

FOREIGN PATENT DOCUMENTS

CN 2729929 Y * 9/2005 ..... H01Q 1/42
CN 2729929 Y 10/2012

(Continued)

OTHER PUBLICATIONS

Extended European Search Report, corresponding to Application No. 19187757.0, dated Nov. 29, 2019, 16 pages.

*Primary Examiner* — Ab Salam Alkassim, Jr.
(74) *Attorney, Agent, or Firm* — Myers Bigel, P.A.

(57) ABSTRACT

The present disclosure relates to an antenna housing, comprising: a front housing having a front housing edge; and a back housing having a back housing edge, the front housing edge and the back housing edge engaging each other to assemble the front housing and the back housing together to form the antenna housing. The front housing edge and the back housing edge cooperate with each other to form a sealing interface, including: a first sealing member provided with a first sealing portion; and a second sealing member provided with a second sealing portion, the first sealing portion abutting against the second sealing portion when the front housing and the back housing are assembled so that a (Continued)

clearance fit is formed between the front housing edge and the back housing edge, wherein the second sealing member is further provided with a channel positioned inside the second sealing portion and extending parallel to the second sealing portion.

19 Claims, 5 Drawing Sheets

(56) References Cited

U.S. PATENT DOCUMENTS

| | | | | |
|---|---|---|---|---|
| 2014/0125550 | A1* | 5/2014 | Kaneko | H01Q 1/24<br>343/872 |
| 2016/0315376 | A1* | 10/2016 | Motomura | H01Q 1/3275 |
| 2017/0346176 | A1* | 11/2017 | Linn | H01Q 21/064 |
| 2017/0373387 | A1* | 12/2017 | Ohlsson | H01Q 1/42 |
| 2018/0034143 | A1* | 2/2018 | Nishikawa | H01Q 1/42 |

FOREIGN PATENT DOCUMENTS

| | | | | |
|---|---|---|---|---|
| CN | 107196059 | A | * | 9/2017 |
| WO | 2004/070878 | A1 | | 8/2004 |

* cited by examiner

ANTENNA HOUSING

CROSS-REFERENCE TO RELATED APPLICATION

The present application claims priority under 35 U.S.C. § 119 to Chinese Patent Application No. 201810814952.5 (Serial No. 2018072401298010), filed Jul. 24, 2018, the entire content of which is incorporated herein by reference.

FIELD OF THE INVENTION

The present disclosure generally relates to the field of antennas and, in particular, to an antenna housing for accommodating an antenna.

BACKGROUND

Antennas that are designed for outdoor use often include an antenna housing and an antenna assembly that is accommodated within the antenna housing. Outdoor antennas are often subjected to harsh conditions, and consequently the antenna housings are typically designed to meet specified waterproof performance levels and to be capable of resisting wind of certain strength. For example, base station antennas are often required to meet a waterproof rating of IP55 and to exhibit no visible damage when subjected to wind speeds of up to 241 km/hour.

A monolithic (single-piece) antenna housing such as an integrally-molded may have excellent waterproofing characteristics. However, an integrally-molded antenna housing may also have certain drawbacks. For example, in order to meet the requirement of radio frequency (RF) matching, the back portion of the antenna housing may need to be made of a metal, such as aluminum. In contrast, the front portion of the antenna may need to be substantially transparent to RF radiation so that the antenna can transmit and receive RF signals. Consequently, if an integrally molded housing is used, it is typically necessary to provide a separate metal backframe that is inserted within the integrally-molded housing. Additionally, it may be more difficult to insert an antenna assembly into an integrally-molded antenna housing.

In light of the difficulties with an integrally-molded antenna housing, it may be advantageous in some applications to use multi-part antenna housings that include two or more separate pieces. However, an attendant problem is how to ensure the sealing and waterproof performance of such a multi-piece antenna housing while also ensuring that it withstand high wind speeds. Providing a multi-piece antenna housing that meets stringent waterproofing and wind speed specifications can be especially challenging with respect to large antennas.

SUMMARY

An object of the present disclosure is to provide a multi-piece antenna housing that is easy to assemble.

Another object of the present disclosure is to provide an antenna housing with high sealing and waterproof performances.

A further object of the present disclosure is to provide an antenna housing with sufficient windproof strength.

According to a first aspect of the present disclosure, an antenna housing is provided, including a front housing having a front housing edge and a back housing having a back housing edge, the front housing edge and the back housing edge engaging each other to assemble the front housing and the back housing together to form the antenna housing, wherein the front housing edge and the back housing edge cooperate with each other to form a sealing interface, including a first sealing member provided with a first sealing portion; and a second sealing member provided with a second sealing portion, the first sealing portion abutting against the second sealing portion when the front housing and the back housing are assembled so that a clearance fit is formed between the front housing edge and the back housing edge, wherein the second sealing member is further provided with a channel positioned inside the second sealing portion and extending parallel to the second sealing portion.

In an embodiment of the antenna housing, the front housing edge and the back housing edge are slidably engaged with each other.

In an embodiment of the antenna housing, the antenna housing defines a longitudinal direction, and the front housing edge and the back housing edge extend substantially parallel to the longitudinal direction.

In an embodiment of the antenna housing, the first sealing member is integrally formed with the front housing, and the second sealing member is integrally formed with the back housing.

In an embodiment of the antenna housing, the first sealing member and the front housing are made by pultrusion molding, and the second sealing member and the back housing are made by extrusion molding.

In an embodiment of the antenna housing, the first sealing portion is formed with a first abutment surface, the second sealing portion is formed with a second abutment surface, and when the front housing and the back housing are assembled, the first abutment surface and the second abutment surface contact each other.

In an embodiment of the antenna housing, when the front housing and the back housing are assembled, the front housing and the back housing contact each other merely through the first sealing portion and the second sealing portion.

In an embodiment of the antenna housing, the first sealing member is formed with an outer wall that extends from the first sealing portion, and when the front housing and the back housing are assembled, the outer wall is located outside the first sealing portion.

In an embodiment of the antenna housing, the second sealing member is formed with an inner wall, the channel being defined between said inner wall and the second sealing portion, and when the front housing and the back housing are assembled, a portion of the inner wall for defining said channel is located inside the second sealing portion and the channel.

In an embodiment of the antenna housing, the second sealing member is further provided with a stop element configured to prevent, after the front housing and the back housing are assembled, the front housing and the back housing from being separated in a direction different from the direction in which the front housing and the back housing are assembled.

In an embodiment of the antenna housing, the second sealing member is further provided with a reinforcing element configured to cooperate with the front housing to enhance the deformation resistance of the antenna housing.

In an embodiment of the antenna housing, the inner wall includes a first inner wall section, with the channel being defined between said first inner wall section and the second sealing portion.

In an embodiment of the antenna housing, the inner wall further includes a second inner wall section serving as the stop element and configured to prevent, after the front housing and the back housing are assembled, the front housing and the back housing from being separated in a direction different from the direction in which the front housing and the back housing are assembled.

In an embodiment of the antenna housing, the second inner wall section extends at an angle relative to the first inner wall section so as to at least partially cover the first sealing member.

In an embodiment of the antenna housing, the first sealing member is formed with a portion corresponding to the second inner wall section, which portion is close to the second inner wall section.

In an embodiment of the antenna housing, the inner wall further includes a third inner wall section serving as the reinforcing element and configured to cooperate with the front housing to enhance the deformation resistance of the antenna housing.

In an embodiment of the antenna housing, the third inner wall section is close to the front housing and extends substantially parallel to the front housing.

In an embodiment of the antenna housing, the first sealing member is formed with an insertion portion which extends from the first sealing portion, and extends into the channel when the front housing and the back housing are assembled.

In an embodiment of the antenna housing, the insertion portion has a cross-sectional shape substantially corresponding to a cross-sectional shape of the channel, and has a cross-sectional area smaller than a cross-sectional area of the channel such that a gap is formed between the insertion portion and the channel.

In an embodiment of the antenna housing, the antenna housing further includes an end cap, which is engaged to end portions of the front housing and the back housing after the front housing and the back housing are assembled.

In an embodiment of the antenna housing, the end cap is provided with an orifice which is in fluid communication with the channel of the second sealing member.

In an embodiment of the antenna housing, the front housing is made of glass fiber, and the back housing is made of aluminum.

According to a first aspect of the present disclosure, an antenna housing is provided, including a front housing having a front housing edge and a back housing having a back housing edge, the front housing edge and the back housing edge engaged with each other to assemble the front housing and the back housing together to form the antenna housing, wherein the front housing edge includes a longitudinally-extending U-shaped member and the back housing edge includes a longitudinally-extending rail that is received within the longitudinally-extending U-shaped member of the front housing edge, wherein a rearwardly facing surface of the longitudinally-extending U-shaped member of the front housing and a front surface of the longitudinally-extending rail cooperate with each other to form a sealing interface, wherein an open channel is positioned inside the longitudinally-extending rail.

BRIEF DESCRIPTION OF THE DRAWINGS

After reading the embodiments below in combination with the drawings, a plurality of aspects of the present disclosure will be better understood. In the drawings.

DETAILED DESCRIPTION

Figure 1:
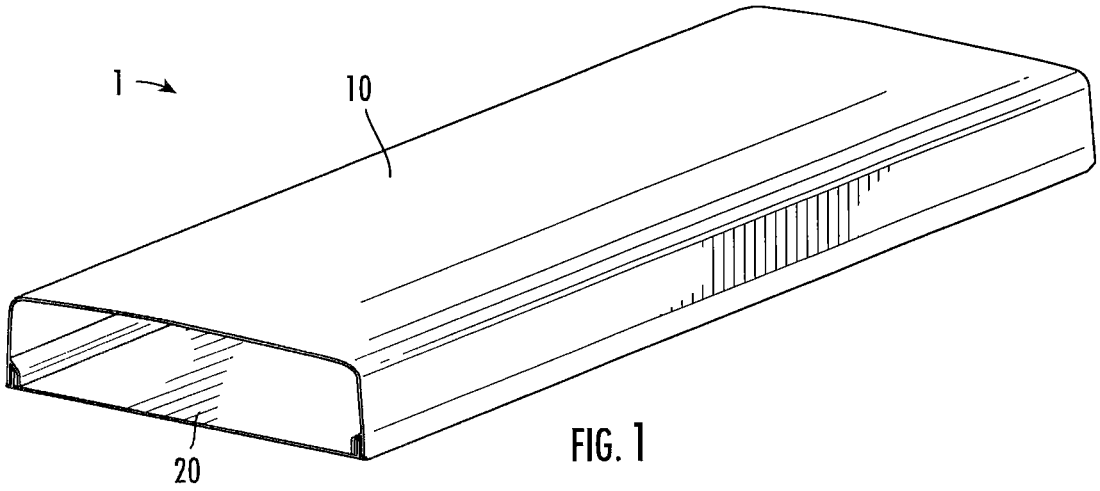
FIG. 1 is a perspective view of an antenna housing according to an embodiment of the present disclosure.

The present disclosure will be described below with reference to the drawings, in which several embodiments of the present disclosure are shown. However, it is to be understood that the present disclosure may be embodied in many different forms and should not be construed as limited to the embodiments that are described herein. Rather, these embodiments are provided so that this disclosure will be thorough and complete, and will fully convey the scope of the invention to those skilled in the art. It will also be appreciated that the embodiments disclosed herein can be combined in any way to provide many additional embodiments.

It should be understood that like numbers refer to like elements throughout. In the figures, the size of certain features may be modified for clarity.

It should be understood that the terminology used herein is for the purpose of describing particular embodiments only and is not intended to be limiting of the present disclosure. Unless otherwise defined, all terms (including technical and scientific terms) used herein have the same meaning as commonly understood by one of ordinary skill in the art to which this disclosure belongs. Well-known functions or constructions may not be described in detail for brevity and/or clarity.

As used herein, the singular forms "a/an", "said" and "the" are intended to include the plural forms as well, unless the context clearly indicates otherwise. The terms "comprising", "encompassing" and "containing" when used in this specification, specify the presence of stated features, but do not preclude the presence of one or more other features. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y". As used herein, phrases such as "from about X to Y" mean "from about X to about Y.".

In the specification, when an element is referred to as being "on" another element, "attached" to another element, "connected" to another element, "coupled" to another element, "contacting" another element, etc., the element may be directly located on another element, attached to another element, connected to another element, coupled to another element or contacting another element, or intervening elements may also be present. In contrast, when an element is referred to as being "directly on" another element, "directly attached" to another element, "directly connected" to another element, "directly coupled" to another element or "directly contacting" another element, there are no intervening elements present. In the specification, where one feature is arranged to be "adjacent" to another feature, it may mean that one feature has a portion that overlaps with an adjacent feature or a portion that is located above or below an adjacent feature.

Spatially relative terms, such as "above", "below", "left", "right", "front", "rear", "high", "low" and the like, may be used herein to describe one feature's relationship to another feature(s) as illustrated in the figures. It will be understood that the spatially relative terms are intended to encompass different orientations of the device in use or operation in addition to the orientation depicted in the figures. For example, if the device in the figures is inverted, features described as "under" other features would then be described as "above" the other features. The device may be otherwise oriented (rotated 90 degrees or at other orientations) and the descriptors of relative spatial relationships used herein shall be interpreted accordingly.

Figure 3:
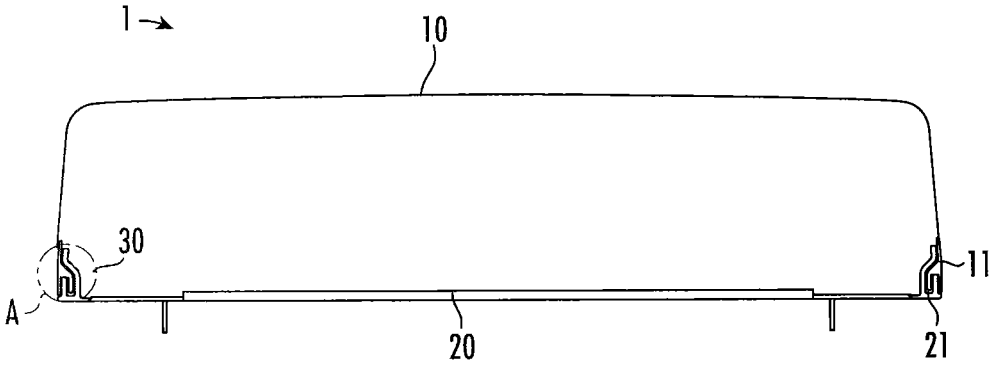
FIG. 3 is a cross-sectional view of the antenna housing shown in FIG. 1.

Several embodiments of an antenna housing 1 according to the present disclosure will be described in detail below with reference to the accompanying drawings. For convenience of description, the direction perpendicular to the cross-sectional view of FIG. 3 (i.e., the direction extending into the page) is defined as a longitudinal direction of the antenna housing, the left-and-right direction along the cross-sectional view of FIG. 3 is defined as a transverse direction, and the up-and-down direction along the cross-sectional view of FIG. 3 is defined as a front-and-rear direction. Those skilled in the art will understand that the above directional definitions are only for the purpose of clear description and are not limitative.

The antenna housing 1 according to the present disclosure is of a multi-part that design includes at least two housing parts. The different housing parts may be made of the same or different materials. The antenna housing 1 according to the present disclosure is particularly suitable for large-sized antennas. In the case of large antennas, the individual housing parts are usually made by an extrusion process, and thus, it may be not suitable that the individual housing parts are engaged with each other by interference fit; accordingly, the separate pieces of the antenna housing 1 according to the present disclosure are engaged with each other by means of a clearance fit.

Figure 2:
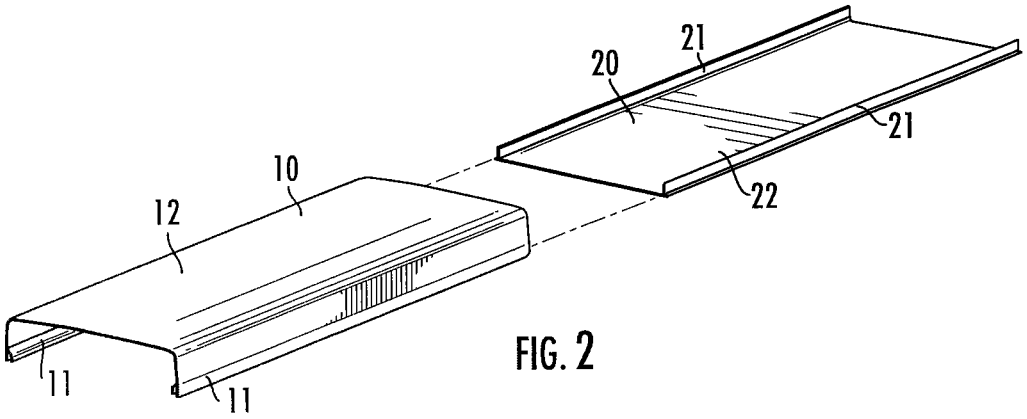
FIG. 2 is an exploded perspective view of the antenna housing shown in FIG. 1.

Referring to FIG. 1 and FIG. 2, an embodiment of the antenna housing 1 according to the present disclosure is shown. The antenna housing 1 includes a front housing 10 and a back housing 20, which are assembled together to form the antenna housing 1. An antenna assembly can be accommodated within the interior of the assembled antenna housing 1. In an example embodiment, the front housing 10 may be made of fiberglass by pultrusion molding, and the back housing 20 may be made of aluminum by extrusion molding. Forming the back housing 20 out of aluminum may allow the antenna housing to meet the RF matching requirement for the antenna, while the forming the front housing 10 out of fiberglass may reduce material costs and allow for low-loss transmission and reception of RF signals. Those skilled in the art will understand that the above-described materials and molding methods are merely illustrative and not limiting. For example, the front housing 1 may also be made of other materials such as PVC.

The front housing 10 has a front housing edge 11 which is located at the edge on two opposite sides of the body 12 of the front housing 10 and extends substantially in the longitudinal direction. In the illustrated embodiment, the front housing 10 includes two front housing edges 11. The front housing edges 11 may be located rearwardly of the body 12 of the front housing 10 in some embodiments.

Similarly, the back housing 20 has a back housing edge 21 which is located at the edge on two opposite sides of the body 22 of the back housing 20 and extends substantially in the longitudinal direction. In the illustrated embodiment, the back housing 20 includes two back housing edges 21. The back housing edges 21 may be located forwardly of the body 22 of the back housing 20 in some embodiments. In the description that follows, the interface between one of the front housing edges 11 and a corresponding one of the back housing edges 21 will be described in greater detail.

When the front housing 10 and the back housing 20 are assembled, the front housing edge 11 and the back housing edge 21 contact and engage with each other so that the front housing 10 and the back housing 20 are assembled to form the antenna housing 1.

Figure 5:
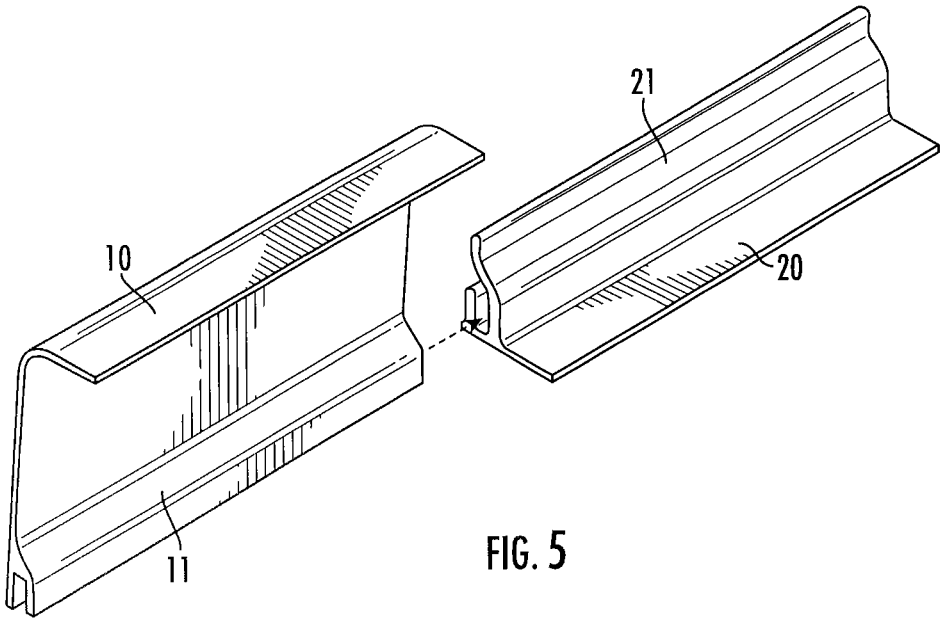
FIG. 5 is a partially exploded perspective view of the antenna housing shown in FIG. 1 prior to assembly.
Figure 6:
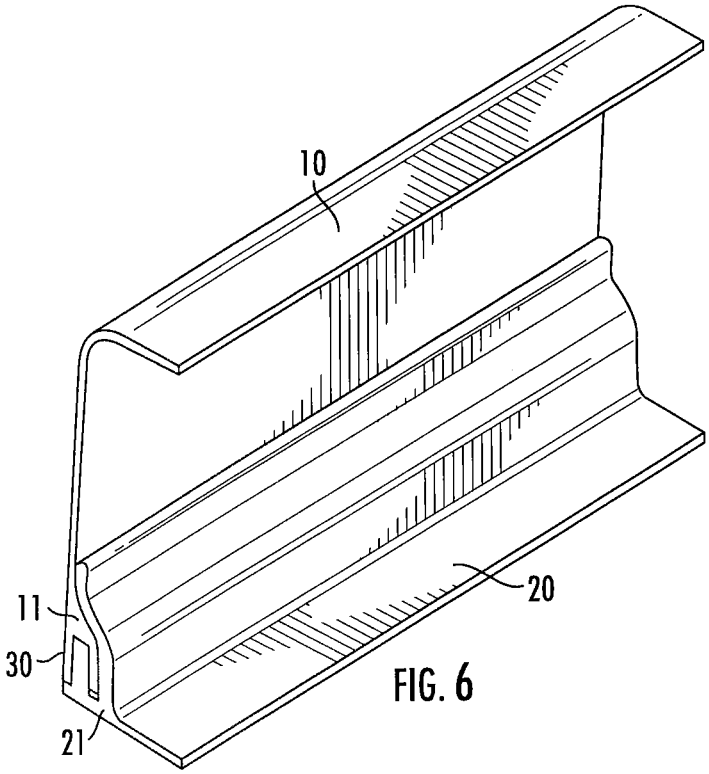
FIG. 6 is a partially perspective view of the antenna housing shown in FIG. 1 after assembly.

According to an embodiment of the present disclosure, the front housing 10 and the back housing 20 may be slidably assembled. For example, the front housing edge 11 is slidable along the back housing edge 21 so that the front housing 10 engages the back housing 20. With specific reference to FIG. 5 and FIG. 6, a process of assembling the front housing 10 and the back housing 20 is shown.

Figure 4:
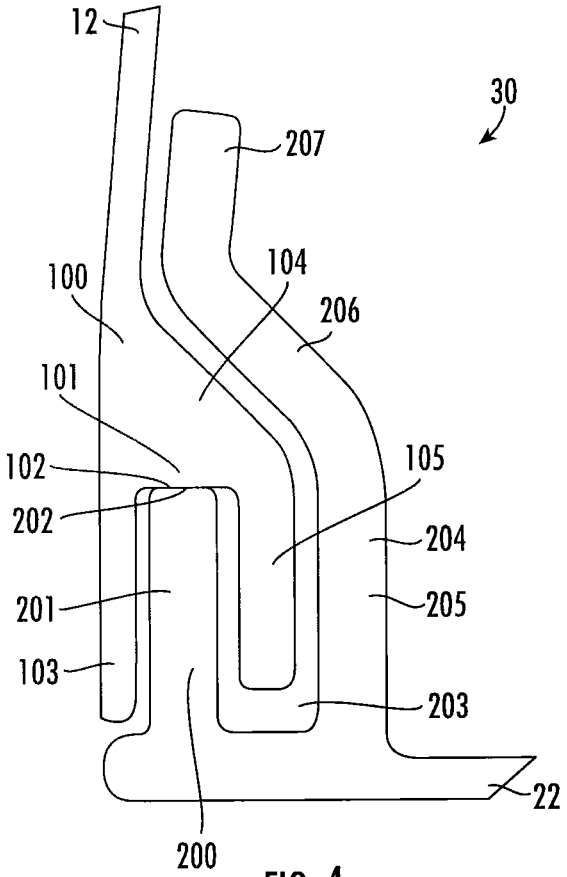
FIG. 4 is an enlarged schematic view of part A in FIG. 3.

Referring to FIG. 3 and FIG. 4, an embodiment of the antenna housing 1 according to the present disclosure is shown. FIG. 3 shows a cross-sectional view of the antenna housing 1, and FIG. 4 shows an enlarged schematic view of part A in FIG. 3.

As shown in FIG. 3, when the front housing 10 and the back housing 20 are assembled, the front housing edge 11 of the front housing 10 and the back housing edge 21 of the back housing 20 cooperate with each other to form a sealing interface 30. The sealing interface 30 is used for sealing the front housing 10 and the back housing 20 to reduce or prevent water and/or moisture ingress into the interior of the antenna housing 1, and may, at the same time be designed to guide the discharge of liquid such as water that seeps into the interface between the front housing 10 and the back housing 20 such that the liquid is prevented from entering the interior of the antenna housing 1 to thereby obtain a waterproof performance of IP55 rating. In addition, the sealing interface 30 can also be used to enhance the capacity of the antenna housing 1 in withstanding frontal and lateral wind so that no visible damage to the antenna housing 1 occurs at wind speeds of up to 241 km/h.

With specific reference to FIG. 4, a cross-sectional view of the sealing interface 30 is shown. Those skilled in the art will understand that the sealing interface 30 may extend along the entire front housing edge 11 and the back housing edge 21. The sealing interface 30 may have the same cross-sectional shape over the entire length of the antenna housing.

The sealing interface 30 includes a first sealing member 100 and a second sealing member 200. The first sealing member 100 may be disposed on the front housing edge 11 of the front housing 10, and may be integrally formed with the front housing 10. Similarly, the second sealing member 200 may be disposed on the back housing edge 21 of the back housing 20, and may be integrally formed with the back housing 20.

The first sealing member 100 may be provided with a first sealing portion 101, and the second sealing member 200 may be provided with a second sealing portion 201. When the front housing 10 and the back housing 20 are assembled, the first sealing portion 101 contacts and abuts against the second sealing portion 201 to form a seal, reducing the ability of liquid such as water from seeping past the mated sealing portions 101, 201. In the illustrated embodiment, both the first sealing portion 101 and the second sealing portion 201 extend in the longitudinal direction of the antenna housing 1.

The first sealing portion 101 is formed with a first abutment surface 102 which is preferably flat. The second sealing portion 201 is formed with a second abutment surface 202 which is preferably flat. When the front housing 10 and the back housing 20 are assembled, the first abutment surface 102 and the second abutment surface 202 contact and abut against each other.

The first abutment surface 102 may extend parallel to the longitudinal direction and the transverse direction, i.e. perpendicular to the front-and-rear direction. Likewise, the second abutment surface 202 may extend parallel to the longitudinal direction and the transverse direction, i.e. perpendicular to the front-and-rear direction. In this way, the first abutment surface 102 and the second abutment surface 202 abut against each other in the front-and-rear direction such that during service of the antenna housing 1, the front housing 10 and the back housing 20 assembled together can withstand the frontal wind, i.e. the wind load applied in the front-and-rear direction, by means of abutment of the first abutment surface 102 and the second abutment surface 202 in the front-and-rear direction.

During the assembly of the front housing 10 and the back housing 20, the first sealing portion 101 abuts against the second sealing portion 201 and slides in the longitudinal direction of the antenna housing 1 with respect to the second sealing portion 201. When the first sealing portion 101 slides to a designated position with respect to the second sealing portion 201, the assembly of the front housing 10 and the back housing 20 is completed. For example, the first sealing portion 101 may slide in the longitudinal direction with respect to the second sealing portion 201 to a position where both ends of the first sealing portion 101 and both ends of the second sealing portion 201 are aligned with each other.

The first sealing member 100 may also be formed with an outer wall 103 which extends from the first sealing portion 101. Specifically, as shown in FIG. 4, the outer wall 103 may extend rearwardly from the first sealing portion 101 toward the back housing 20 in the front-and-rear direction, and in the embodiment of FIG. 4 it extends toward the body 22 of the back housing 20, and can extend to be close to the body 22.

In the embodiment shown in FIG. 4, the outer wall 103 is located outside the second sealing portion 201, i.e., the second sealing portion 201 is closer to the interior of the antenna housing 1 than the outer wall 103. The outer wall 103 may extend substantially parallel to the second sealing portion 201, and may at least partially and even substantially cover the second sealing portion 201. Thus, the outer wall 103 may further inhibit liquid such as water from entering the interior of the antenna housing 1. Further, the outer wall 103 may combine with the body 12 of the front housing 10 to form a smooth outer surface to thereby provide a sleek appearance.

The second sealing member 200 may define a channel 203, which may be configured to guide and discharge out of the antenna housing 1 any liquid that seeps past the barrier formed by the abutting first and second sealing portions 101, 201. The channel 203 may be provided inside the second sealing portion 201, i.e., it may be closer to the interior of the antenna housing 1 than the second sealing portion 201. The channel 203 may be positioned adjacent to the second sealing portion 201 and may extend substantially parallel to the second sealing portion 201.

The second sealing member 200 may include an inner wall 204, which may extend generally from the body 22 of the back housing 20 toward the front housing 10 in some embodiments. However, this is not limiting and the inner wall 204 may alternatively extend from other locations of the antenna housing 1. For example, as shown in the embodiments in FIG. 8 and FIG. 10, the inner wall 204 may extend from the second sealing portion 201 toward the front housing 10.

The inner wall 204 may include a first inner wall section 205 which, in the embodiment shown in FIG. 4, extends generally in the front-and-rear direction from the body 22 of the back housing 20 toward the front housing 10. However, this is not limiting and the first inner wall section 205 may also extend from other locations of the antenna housing 1. For example, as shown in the embodiments in FIG. 8 and FIG. 10, the first inner wall section 205 may extend from the second sealing portion 201 toward the front housing 10 and may extend in a direction inclined with respect to the front-and-rear direction. The first inner wall section 205 may be provided inside the channel 203 and the second sealing portion 201, that is, being closer to the interior of the antenna housing 1 than the channel 203. The first inner wall section 205 and the second sealing portion 201 collectively define the channel 203.

The inner wall 204 may also include a second inner wall section 206, which may extend at an angle relative to the first inner wall section 205. As shown in FIG. 4, the second inner wall section 206 may be obtuse-angled with respect to the first inner wall section 205. However, this is not limiting and the second inner wall section 206 may also extend at other angles with respect to the first inner wall section 205. For example, as shown in the embodiments in FIG. 8 and FIG. 10, the second inner wall section 206 may be at a right angle with respect to the first inner wall section 205 in some embodiments.

The second inner wall section 206 may extend relative to the first inner wall section 205 to at least partially cover the first sealing member 101, thereby serving as a stop element to prevent, after the front housing 10 and the back housing 20 are assembled, the front housing 10 and the back housing 20 from being separated in a direction different from the direction in which the front housing 10 and the back housing 20 are assembled. For example, after the front housing 10 slides in place in the longitudinal direction with respect to the back housing 20, a blocking effect is generated since the second inner wall section 206 at least partially covers the first sealing member 101, preventing the front housing 10 from being separated in the front-and-rear direction with respect to the back housing 20.

In the case where the second inner wall section 206 is configured to act as a stop element, the first sealing member 100 may be formed with a portion 104 corresponding to the second inner wall section 206. The portion 104 is positioned generally close to the second inner wall section 206 so as to cooperate with the second inner wall section 206 to prevent the front housing 10 and the back housing 20 from separation. For example, the portion 104 may have a surface that extends generally in parallel to a corresponding surface of the second inner wall section 206. That is, when the front housing 10 moves relative to the back housing, for example, in the front-and-rear direction in an attempt to separate from the latter, the portion 104 will abut against the second inner wall section 206, and thus will be stopped by the second inner wall section 206 thereby resisting the front housing 10 from separating from the back housing 20.

The inner wall 204 may also include a third inner wall section 207, which serves as a reinforcing element and is configured to cooperate with the front housing 10 to enhance the deformation resistance of the antenna housing. The third inner wall section 207 may extend forwardly and may be positioned close to the front housing 10. The third inner wall section 207 may extend substantially parallel to a side surface of the front housing 10. In the illustrated embodiment, the third inner wall section 207 extends substantially in the longitudinal direction of the antenna housing 1.

When the antenna housing 1 is subjected to a transverse lateral wind, i.e. a wind load along the transverse direction, it is possible that the front housing 10, for example, may be blown inwardly and deformed. The third inner wall section 207 may act as a reinforcing element, and hence the front housing 10, when deformed, will contact and abut against the third inner wall section 207; whereby the third inner wall section 207 prevents further deformation of the front housing 10. With the third inner wall section 207 serving as a reinforcing element cooperating with the front housing 10, the capacity of the antenna housing 1 in resisting transverse lateral wind or transverse wind load may be improved.

The first sealing member 100 may also be provided with an insertion portion 105, which extends from the first sealing portion 101. When the front housing 10 and the back housing 20 are assembled, the insertion portion 105 extends into the channel 203 of the second sealing member 200 and extends along the channel 203.

With the insertion portion 105 extending into the channel 203, liquid such as water can be further prevented from entering the interior of the antenna housing 1. When liquid possibly passes through the interface between the first sealing portion 101 and the second sealing portion 201, due to the presence of the insertion portion 105, the liquid may not splash directly to the interior of the antenna housing 1 across the channel 203; instead, the liquid may be blocked by the insertion portion 105, enter into the channel 203, and may be discharged out of the antenna housing 1 through guidance of the channel 203.

The insertion portion 105 may have a cross-sectional shape substantially corresponding to a cross-sectional shape of the channel 203, and may have a cross-sectional dimension smaller than that of the channel 203. For example, the insertion portion 105 may have a cross-sectional area smaller than a cross-sectional area of the channel 203, such that a gap is formed between the insertion portion 105 and the channel 203. The gap thus formed can optimally block liquid and introduce liquid into the channel 203 to facilitate the subsequent discharge thereof.

Those skilled in the art will understand that the above description about the shape and size of the insertion portion 105 and the channel 203 is merely exemplary and not limiting. For example, the cross-sectional shape of the insertion portion 105 may be different from that of the channel 203.

The antenna housing 1 according to the present disclosure may be assembled by sliding the front housing 10 relative to the back housing 20. When assembled, the front and back housings may engage each other via a clearance fit rather than an interference fit. Specifically, the clearance fit is formed between the front housing edge 11 of the front housing 10 and the back housing edge 21 of the back housing 20. In an embodiment, where the front housing 10 and the back housing 20 are assembled by sliding fit, only the first sealing portion 101 and the second sealing portion 201 may contact each other, which can reduce the friction during assembly and improve the assembling convenience of the antenna housing 1.

When the front housing 10 and the back housing 20 are assembled by sliding fit, the first sealing portion 101 may serve as a slide rail, and the second sealing portion 201 may serve as a slider. Further, in the case where the outer wall 103 and the insertion portion 105 are provided, the first sealing portion 101, the outer wall 103 and the insertion portion 105 may collectively form a substantially U-shaped slide rail, which facilitates sliding the second sealing portion 201 therein and facilitates the assembly of the front housing 10 with the back housing 20.

In the embodiment shown in FIG. 4, as the second inner wall section 206 extends at an obtuse angle with respect to the first inner wall section 205, the portion 104 of the first sealing member 100 also extends at an obtuse angle with respect to the front-and-rear direction, i.e., is at an obtuse angle with respect to the body 12 of the front housing 10 and the insertion portion 105. Such a design is advantageous during extrusion molding, since the obtuse-angle design facilitates the flow of the extruded material from the site of the body 11 to the portion 104 and further to the insertion section 105.

The antenna housing 1 according to the present disclosure further includes an end cap (not shown in the figures), which is engaged to the end portion of the front housing 10 and the end portion of the back housing 20 after the front housing 10 and the back housing 20 are assembled. For example, the antenna housing 1 may include a top end cap and a bottom end cap that are engaged to two opposite ends of the front housing 10 and the back housing 20 respectively, thereby forming a substantially closed housing with the front housing 10 and the back housing 20.

The bottom end cap may be provided with an orifice in fluid communication with the channel 203 of the second sealing member 200 so that liquid entering the channel 203 can be discharged out of the antenna housing 1 through the orifice in the end cap.

In practical use, the antenna housing 1 is generally erected, i.e. its longitudinal direction corresponds to the vertical direction. In this way, the channel 203 extends in the vertical direction; accordingly, after any liquid enters the channel 203, it can be discharged from the orifice of the bottom end cap by gravity via guidance of the channel 203.

Figure 7:
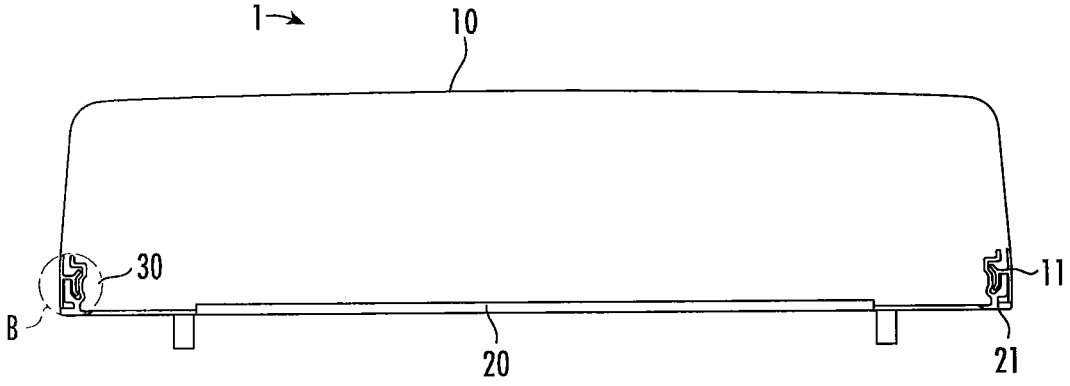
FIG. 7 is a cross-sectional view of an antenna housing according to another embodiment of the present disclosure.
Figure 8:
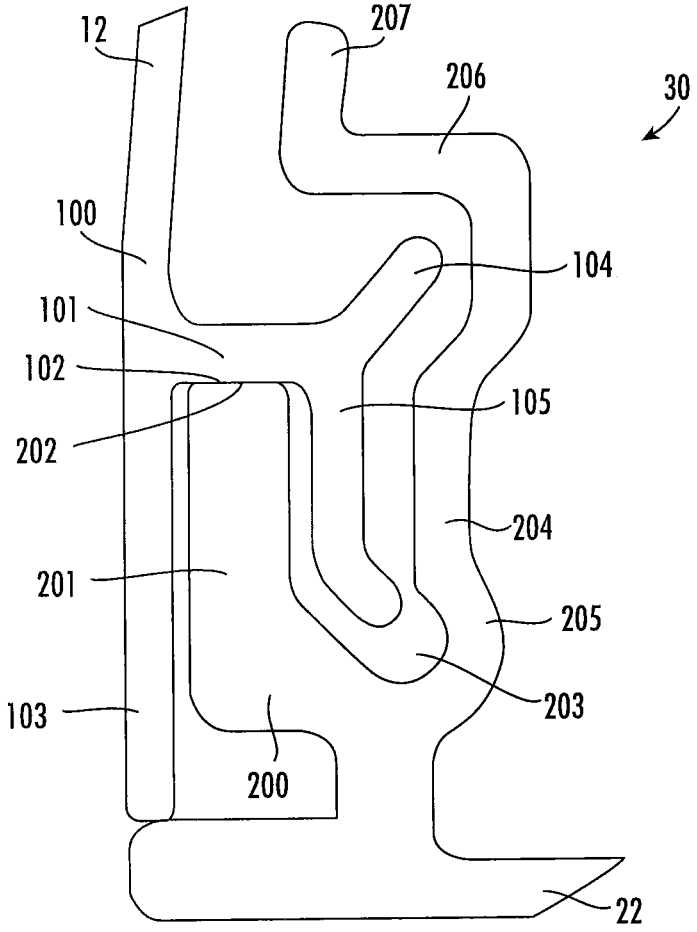
FIG. 8 is an enlarged schematic view of part B in FIG. 7.

FIG. 7 and FIG. 8 show another embodiment of the antenna housing 1 according to the present disclosure. In the embodiment shown in FIG. 4, the cross section of the first sealing member 100 is formed in a substantially "h" shape, whereas in the embodiment shown in FIG. 7 and FIG. 8, the cross section of the first sealing member 100 is formed in a substantially "k" shape. The insertion portion 105 protrudes from the first sealing portion 101 toward the channel 203, and the portion 104 protrudes from the first sealing portion 101 toward the second inner wall section 206. Correspondingly, the inner wall 204 of the second sealing member 200 is formed such that the first inner wall section 205 extends in the front-and-rear direction, the second inner wall section 206 extends in the transverse direction, and the third inner wall section 207 extends in the front-and-rear direction toward the front housing 10.

Figure 9:
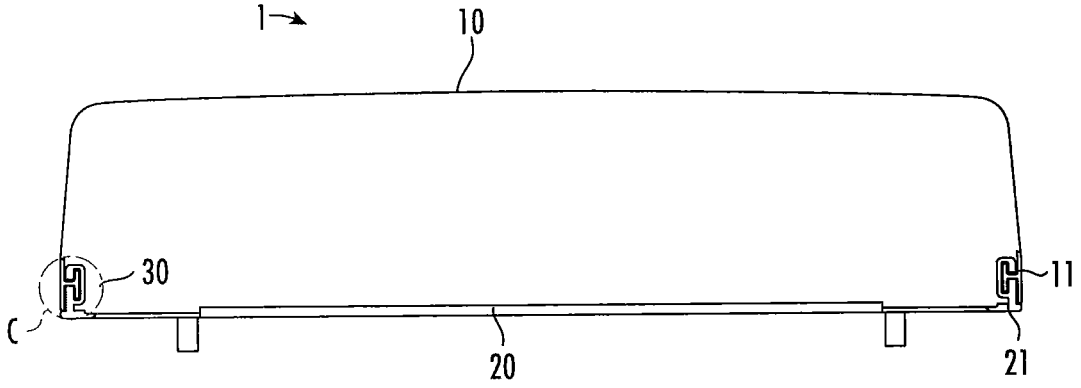
FIG. 9 is a cross-sectional view of an antenna housing according to a further embodiment of the present disclosure.
Figure 10:
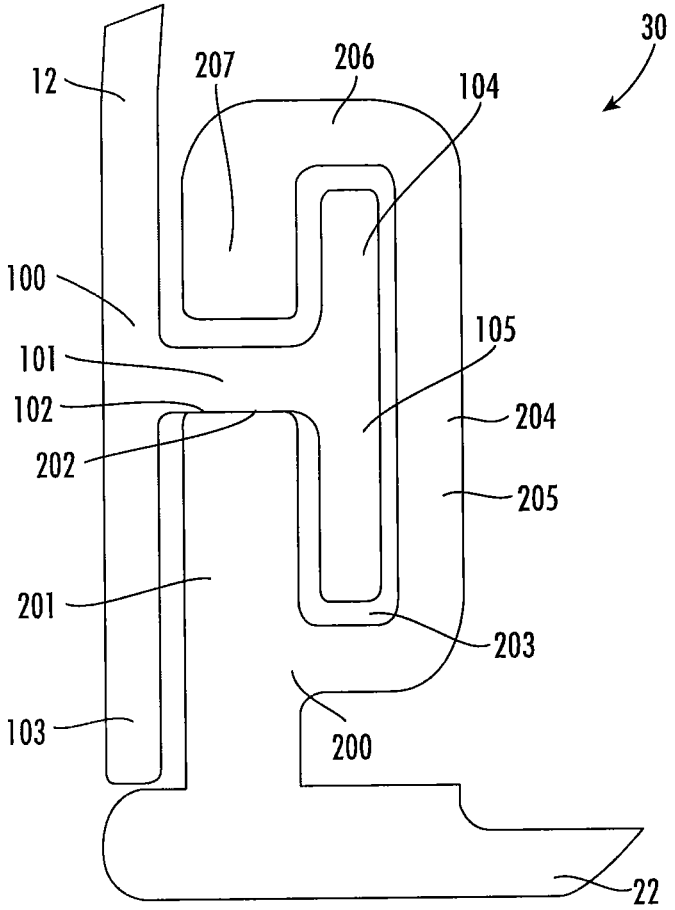
FIG. 10 is an enlarged schematic view of part C in FIG. 9.

FIG. 9 and FIG. 10 show a further embodiment of the antenna housing 1 according to the present disclosure, wherein the cross section of the first sealing member 100 is formed in a substantially "I" shape. Correspondingly, the cross section of the second sealing member 200 is formed in a substantially "C" shape, wherein the first inner wall section 205 extends in the front-and-rear direction, the second inner wall section 206 extends in the transverse direction, and the third inner wall section 207 extends in the front-and-rear direction from the second inner wall section 207 toward the body 22 of the back housing 20.

Although exemplary embodiments of this disclosure have been described, those skilled in the art should appreciate that many variations and modifications are possible in the exemplary embodiments without materially departing from the spirit and scope of the present disclosure. Accordingly, all such variations and modifications are intended to be included within the scope of this disclosure as defined in the claims. The present disclosure is defined by the appended claims, and equivalents of these claims are also contained.

That which is claimed is:

1. An antenna housing, comprising:

a front housing having a front housing edge; and a back housing having a back housing edge, the front housing edge and the back housing edge engaged with each other to assemble the front housing and the back housing together to form the antenna housing, wherein the front housing edge and the back housing edge cooperate with each other to form a sealing interface including:

a first sealing member provided with a first sealing portion; and a second sealing member provided with a second sealing portion, the first sealing portion abutting against the second sealing portion when the front housing and the back housing are assembled so that a clearance fit is formed between the front housing edge and the back housing edge, wherein the second sealing member is further provided with a channel positioned inside the second sealing portion and extending parallel to the second sealing portion, wherein the first sealing member is formed with an outer wall that extends rearwardly from the first sealing portion toward the back housing.

2. The antenna housing according to claim 1, wherein the front housing edge and the back housing edge are slidably engaged with each other.

3. The antenna housing according to claim 1, wherein the antenna housing defines a longitudinal direction, and the front housing edge and the back housing edge extend substantially parallel to the longitudinal direction.

4. The antenna housing according to claim 1, wherein the first sealing member is integrally formed with the front housing, and the second sealing member is integrally formed with the back housing.

5. The antenna housing according to any claim, 1 wherein the first sealing member and the front housing are made by pultrusion molding, and the second sealing member and the back housing are made by extrusion molding.

6. The antenna housing according to claim 1, wherein the first sealing portion is formed with a first abutment surface, the second sealing portion is formed with a second abutment surface, and when the front housing and the back housing are assembled, the first abutment surface and the second abutment surface contact each other.

7. The antenna housing according to claim 1, wherein when the front housing and the back housing are assembled, the front housing and the back housing contact each other merely through the first sealing portion and the second sealing portion.

8. The antenna housing according to claim 1, wherein when the front housing and the back housing are assembled, the outer wall is located outside the first sealing portion.

9. The antenna housing according to claim 1, wherein the second sealing member is formed with an inner wall, the channel being defined between said inner wall and the second sealing portion, and when the front housing and the back housing are assembled, a portion of the inner wall for defining said channel is located inside the second sealing portion and the channel.

10. The antenna housing according to claim 9, wherein the inner wall includes a first inner wall section, the channel being defined between said first inner wall section and the second sealing portion.

11. The antenna housing according to claim 10, wherein the inner wall further includes a second inner wall section serving as a stop element and configured to prevent, after the front housing and the back housing are assembled, the front housing and the back housing from being separated in a direction different from the direction in which the front housing and the back housing are assembled.

12. The antenna housing according to claim 11, wherein the second inner wall section extends at an angle relative to the first inner wall section so as to at least partially cover the first sealing member.

13. The antenna housing according to claim 12, wherein the first sealing member is provided with a portion corresponding to the second inner wall section, said portion being close to the second inner wall section.

14. The antenna housing according to claim 11, wherein the inner wall further includes a third inner wall section serving as a reinforcing element and configured to cooperate with the front housing to enhance the deformation resistance of the antenna housing.

15. The antenna housing according to claim 1, wherein the first sealing member is formed with an insertion portion which extends from the first sealing portion, and extends into the channel when the front housing and the back housing are assembled.

16. The antenna housing according to claim 15, wherein the insertion portion has a cross-sectional shape substantially corresponding to a cross-sectional shape of the channel, and has a cross-sectional area smaller than a cross-sectional area of the channel such that a gap is formed between the insertion portion and the channel.

17. The antenna housing according to claim 1, wherein the antenna housing further includes an end cap, which is engaged to end portions of the front housing and the back housing after the front housing and the back housing are assembled.

18. The antenna housing according to claim 17, wherein the end cap is provided with an orifice which is in fluid communication with the channel of the second sealing member.

19. The antenna housing according to claim 1, wherein the front housing is made of fiberglass, and the back housing is made of aluminum.

* * * * *